United States Patent [19]

Brickner et al.

[11] 4,062,370

[45] Dec. 13, 1977

[54] UMBRELLA COVER

[76] Inventors: George Brickner, 553 Lakeview Ave., Rockville Center, N.Y. 11570; Paul P. Budoff, 17 Roosa Ave., Monticello, N.Y. 12701

[21] Appl. No.: 671,011

[22] Filed: Mar. 26, 1976

[51] Int. Cl.[2] ..... A45B 25/18

[52] U.S. Cl. ..... 135/33 C; 47/21; 47/28 R; 150/52

[58] Field of Search ..... 47/20, 21, 22, 28 R, 47/29, 31; 135/19.5, 33 C, 33 R, 34, 5 E; 150/52 R

[56] References Cited

U.S. PATENT DOCUMENTS

| | | | |
|---|---|---|---|
| 663,306 | 12/1900 | Tompkins | 150/52 R |
| 884,473 | 4/1908 | Dawson | 47/28 |
| 1,820,040 | 8/1931 | Zuckerman | 47/28 X |
| 1,834,084 | 12/1931 | Barnes | 47/21 |
| 2,565,680 | 8/1951 | Feld | 150/52 R X |
| 3,490,469 | 1/1970 | Dubinsky | 135/33 C |
| 3,670,749 | 6/1972 | Buschman | 150/52 R X |

*Primary Examiner*—Werner H. Schroeder
*Assistant Examiner*—Conrad L. Berman
*Attorney, Agent, or Firm*—Henry R. Lerner

[57] ABSTRACT

An umbrella cover fabricated of a pliable material and in the general form of a sleeve which may be closed at one end and is open at the other end for receiving the canopy of an umbrella is provided with a cut-out portion adjacent the open end and with means on the cover for engagement by a device for lifting the cover.

4 Claims, 7 Drawing Figures

UMBRELLA COVER

BACKGROUND OF THE INVENTION

This invention relates to covers for the canopies of umbrellas, particularly larger umbrellas such as garden and beach umbrellas.

Larger umbrellas, such as garden and beach umbrellas, are relatively expensive. Consequently, the owners of such umbrellas desire to protect them from the elements in order to extend their life. The canopies of such umbrellas, generally fabricated of a pliable fabric or plastic or combination of the two, such as a laminate, are particularly sensitive to deterioration under the influence of prolonged exposure to the elements.

When larger umbrellas are in an upright position, the upper extremity thereof is frequently beyond the convenient reach of a person of average height. Accordingly, such a person may find it necessary to climb upon a chair, table or the like in order to be able to slip the cover over the umbrella. This is a considerable inconvenience. In light of this inconvenience, in the prior art, as exemplified by U.S. Pat. No. 3,490,469, it has been proposed to provide a sleeve-like umbrella cover with a slit along most of its length, a closure for the slit in the form of a zipper, a rigid member extending adjacent and parallel to the slit and a cord on the slider of the zipper. To place the cover over the folded canopy of the umbrella, one moves the zipper to the position in which the slit is open, grasps the lower extremity of the rigid member and guides the cover laterally onto the canopy. With the cover then resting on the canopy, one grasps the cord on the zipper slider and pulls the slider downwards to close the slit by means of the zipper. A substantial disadvantage of this type of cover, however, is that the cover is not compactly foldable due to the rigid member. Moreover, the rigid member is rather slender and, if it breaks, the cover can no longer be used in the intended way. Also, the rigid member adds to the cost of the umbrella. Furthermore, the use of a slide fastener increases the cost of the cover and renders the same vulnerable in case of malfunction of the slide fastener.

In U.S. Pat. No. 1,820,040, there is disclosed a protecting envelope for trees which envelope is provided at its upper extremity with an eye or ring for engagement by a hook on a long bent pole, whereby the envelope can be lifted and then lowered onto a tree by a worker standing on the ground. The arrangement disclosed in this patent suffers the disadvantage of requiring a special, bent pole for lifting and lowering the envelope. Moreover, registering the opening of the envelope with the tree prior to lowering the envelope over the tree would require raising the envelope entirely above the peak of the tree and thus a certain amount of dexterity.

It is an object of the present invention to provide a cover for an umbrella which cover can conveniently be placed over the canopy of an umbrella, the top of which is beyond convenient reach when the umbrella is in an upright position and which cover can be folded when the cover is not in use.

Other objects and advantages of the invention will be apparent from the description hereof hereinafter.

SUMMARY OF THE INVENTION

According to the invention, the umbrella cover, which is fabricated of a pliable material shaped to fit over the umbrella canopy, is provded with means for engagement by means for lifting the cover and is also provided with a cut-out portion at the edge of the cover surrounding the opening for receiving the umbrella into the cover.

The means on the cover for engagement by means for lifting the cover is, in a preferred embodiment of the invention, an inverted pocket. The means for lifting the cover is then any readily available simple elongated member, such as a pole, an extremity of which is received in the inverted pocket. One lifts the cover by inserting the pole into the inverted pocket and lifting the pole. One then registers the upper extremity of the umbrella with the cut-out portion at the lower edge of the cover. For this purpose, the cut-out portion and the inverted pocket are preferably on the same side of the cover. One then pulls the pole toward one's body until the canopy abuts against the portion of the cover opposite the cut-out portion causing the cover opening to be expanded and then one simply lowers the pole to lower the cover onto the canopy and removes the poles from the inverted pocket. Since the covers frequently fit quite snugly on the canopies, the cover may descend only part way down the canopy when the cover is manipulated with the pole. However, this places the lower portions of the cover within easy reach to permit one to pull the cover the rest of the way down manually. To remove the cover, one simply reinserts the pole into the pocket and pushes the pole upwards to lift the cover off the canopy.

It will be appreciated that when the cut-out portion at the lower edge of the cover is registered with the upper extremity of the umbrella, the upper extremity of the umbrella is above the lower edge of the cover but below the upper edge of the cut-out and the cut-out together with the upper extremity of the umbrella are in the line of sight of the person who is manipulating the cover onto the umbrella. The cut-out thus provides two advantages. One is that the person who is manipulating the cover onto the umbrella does not have to lift the cover so high that the lower edge of the cover is above the upper extremity of the umbrella. The other is that the person who is manipulating the cover onto the umbrella does not have to blindly lower the cover onto the umbrella as he would be obliged to do if it were not for the presence of the cut-out.

It is to be understood that the inverted pocket is merely an example of a means which can be used for the purpose of engagement by means for lifting the cover. Many alternatives are available and are intended to be encompassed within the scope of the present invention. For example, an eye or loop may be provided on the cover and a fork or hook or similar member at the end of the pole for engaging the eye or hook.

The pliable material of the cover is typically a fabric, a pliable plastic or a pliable laminate of fabric and a plastic. Such materials include nylon fabric, polyester fabric, cotton fabric, canvas fabric, fiberglass fabric, pliable polyethylene, polyproplyene, polyvinyl chloride and the like.

DESCRIPTION OF THE PREFERRED EMBODIMENT

Figure 1:
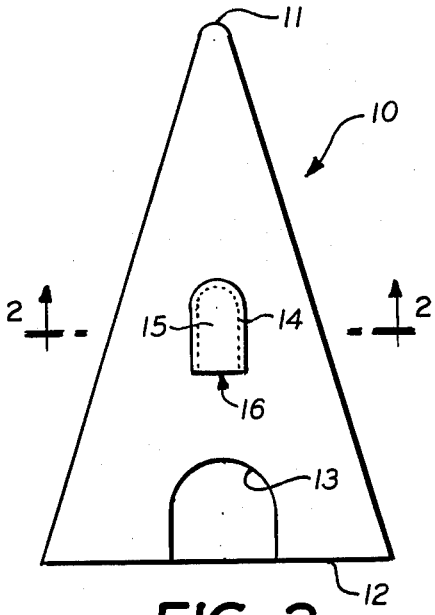
FIG. 1 is an elevation of an umbrella cover according to the invention.
Figure 2:
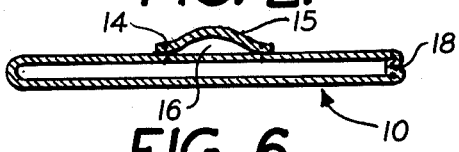
FIG. 2 is a section taken through section line 2-2 of FIG. 1.

It is seen from FIGS. 1 and 2 that the cover 10 is in the configuration of a generally conical sleeve having a closed peak 11 and a free edge defining an opening into the sleeve at the lower extremity of the sleeve. The cover 10 is provided with a cut-out portion 13 contiguous with the lower edge 12.

Sewn onto the outside of the cover 10 by means of stitches 14 is a piece of fabric 15 which together with the stitches 14 defines an inverted pocket 16.

Figure 3:
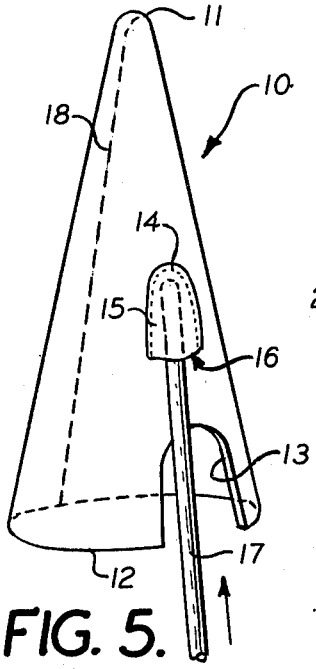
FIG. 3 is a perspective view illustrating the lifting of the cover.

When the cover is to be used, an elongated member 17 which may be, for example, the pole of a garden implement or a broomstick or mop stick, is inserted into the inverted pocket 16 as shown in FIG. 3. A single such pole or stick may be used in covering any number of umbrella canopies, which is economical, particularly where a substantial number of umbrellas are concerned such as at a resort or country club. It is also apparent from FIG. 3, as well as from FIGS. 4 and 5, that the cover 10 is generally fabricated from a flat material by joining edges of the flat material together with a seam 18 which, however, constitutes no part of the present invention.

Figure 4:
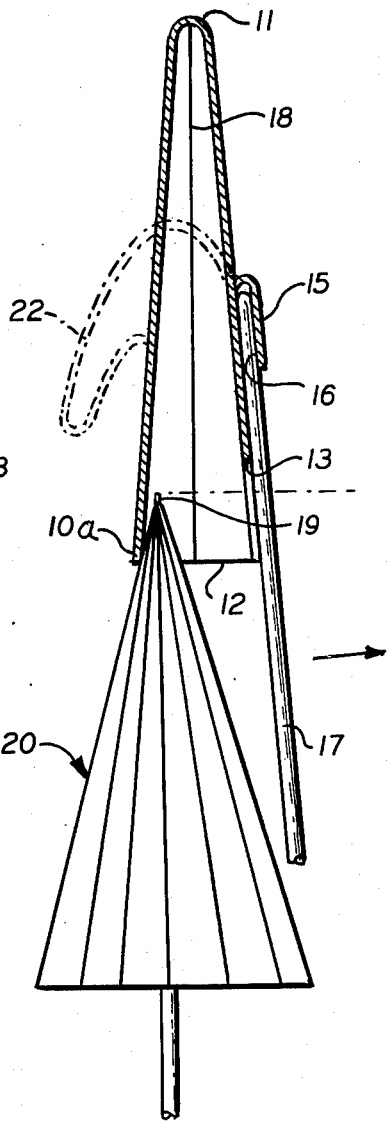
FIG. 4 is an elevation, partly in section, illustrating a stage in the placing of the cover on the umbrella.
Figure 5:
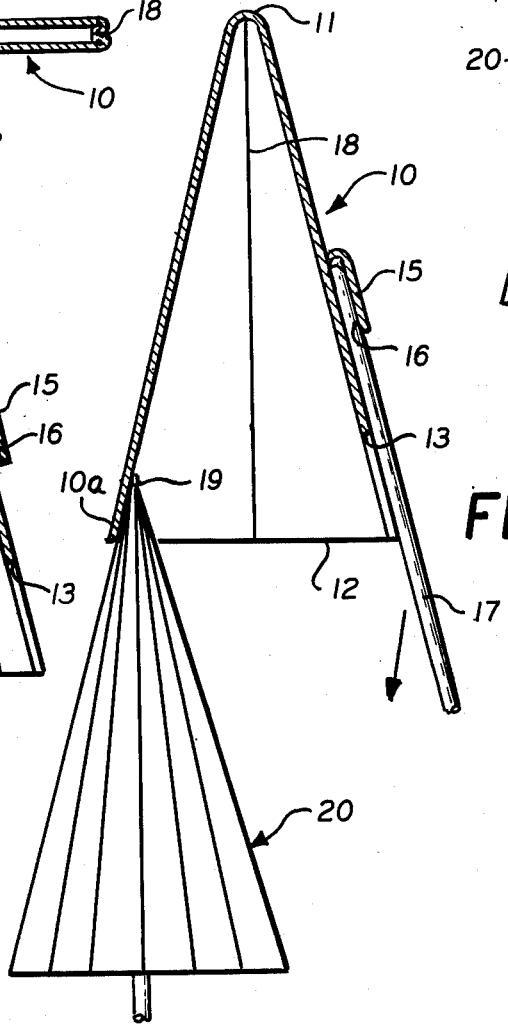
FIG. 5 is a view similar to FIG. 4 showing a more advanced stage in the placing of the cover on the umbrella.
Figure 6:
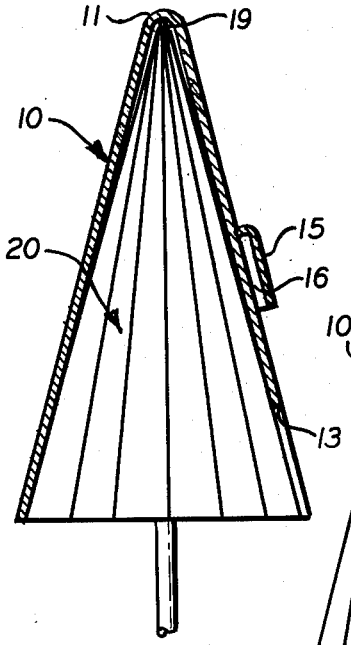
FIG. 6 is a view similar to FIGS. 4 and 5 but showing the cover completely in position over the canopy of the umbrella.
Figure 7:
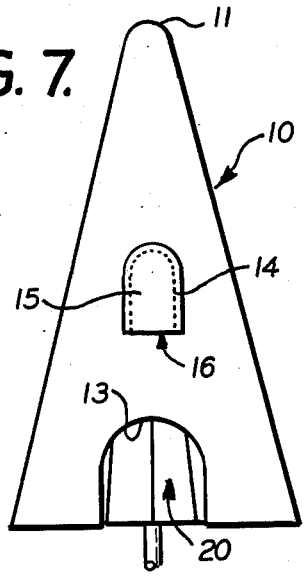
FIG. 7 is an elevation of the umbrella canopy with the cover mounted thereon.

As seen from FIG. 4, the person (not illustrated) holding the pole 17 has registered the upper extremity 19 of umbrella 20 with the opening 13 in the cover 10 and has then pulled the pole 17 toward himself as indicated by the arrow in FIG. 4 until the portion 10*a* of the cover 10 opposite the cut-out portion 13 has abutted against the upper extremity 19 of the umbrella 20. The person then continues this motion until the cover is completely or substantially completely open as shown in FIG. 5 and then lowers the pole 17, as shown by the arrow in FIG. 5, and therewith the cover 10 until the cover 10 descends at least partly over the canopy of the umbrella 20. If the cover fits too snugly on the canopy to descend completely over the cover without being manually pulled on, one then manually pulls the cover the rest of the way down after removing the pole 17 from the pocket 16 until the cover is completely over the canopy as shown in FIGS. 6 and 7.

It will be understood that for purposes of illustration, cover 10 is shown as being made of pliable, yet fairly rigid material. It is within the scope of the invention to utilize a less rigid pliable material as illustrated by the phantom lines 22 in FIG. 4.

While there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

What is claimed is:

1. An umbrella cover comprising a sleeve of a pliable material having a closed extremity and an open extremity for receiving the canopy of an umbrella into the sleeve, said sleeve having a cut-out portion extending from said open extremity toward said closed extremity for a significant distance, and means on the cover for engaging lifting means for said cover, said engagement mean and cut-out portion being substantially in alignment with said closed extremity, whereby one can manipulate the cover onto the umbrella when the umbrella is upright by engaging the engagement means on the cover with the lifting means, lifting the cover by means of the lifting means sufficiently to register the cut-out portion with a significant portion of the upper extremity of the umbrella, pulling the lifting means toward oneself to cause a portion of the cover opposite the cut-out portion to abut against said significant portion of the upper extremity of the umbrella thereby to spread the cover open and lowering the thus opened cover onto the umbrella by lowering the lifting means.

2. A cover according to claim 1, wherein said cut-out portion and said means on the cover are on the same side of the cover.

3. A cover according to claim 1, in which the means for engagement comprises an inverted pocket on the exterior of the cover.

4. A cover according to claim 3, in which the inverted cover is formed by a piece of pliable material fixed onto the exterior of the cover in the form of an inverted pocket.

* * * * *